US008147650B2

(12) United States Patent
Griffiths

(10) Patent No.: US 8,147,650 B2
(45) Date of Patent: Apr. 3, 2012

(54) METHOD AND APPARATUS FOR MANUFACTURING A PRODUCT OF INTEGRATED CELLULOSE AND FIBROUS MATERIALS

(75) Inventor: Alan Lyle Griffiths, Tasmania (AU)

(73) Assignee: Envirobatt Pty. Ltd., Tasmania (AU)

( * ) Notice: Subject to any disclaimer, the term of this patent is extended or adjusted under 35 U.S.C. 154(b) by 79 days.

(21) Appl. No.: 12/524,452

(22) PCT Filed: Jan. 24, 2008

(86) PCT No.: PCT/AU2008/000078

§ 371 (c)(1),
(2), (4) Date: Jul. 24, 2009

(87) PCT Pub. No.: WO2008/089513

PCT Pub. Date: Jul. 31, 2008

(65) Prior Publication Data

US 2010/0051221 A1 Mar. 4, 2010

(30) Foreign Application Priority Data

Jan. 25, 2007 (AU) ..... 2007900378

(51) Int. Cl.
*D21F 11/00* (2006.01)

(52) U.S. Cl. ..... 162/146

(58) Field of Classification Search ..... 162/146, 162/261; 241/98; 428/218; 264/299; 442/344, 442/417

See application file for complete search history.

(56) References Cited

U.S. PATENT DOCUMENTS

| | | | | |
|---|---|---|---|---|
| 4,100,324 | A * | 7/1978 | Anderson et al. | 442/344 |
| 4,187,342 | A * | 2/1980 | Holst et al. | 442/417 |
| 5,318,553 | A | 6/1994 | Weeks et al. | |
| 6,494,974 | B2 * | 12/2002 | Riddell | 156/62.4 |
| 6,645,407 | B2 * | 11/2003 | Kellenberger et al. | 264/115 |
| 6,709,613 | B2 * | 3/2004 | Chambers et al. | 264/121 |
| 2003/0121116 | A1 | 7/2003 | Keck et al. | |
| 2004/0180598 | A1 | 9/2004 | Yang et al. | |

FOREIGN PATENT DOCUMENTS

| | | | |
|---|---|---|---|
| AU | 2003271417 B2 | | 5/2004 |
| EP | 0 635 275 | | 1/1995 |
| GB | 2 024 886 | | 1/1980 |
| WO | 2004035899 | * | 4/2004 |

OTHER PUBLICATIONS

International Search Report mailed Apr. 17, 2008.

* cited by examiner

*Primary Examiner* — Mark Halpern
(74) *Attorney, Agent, or Firm* — Sughrue Mion, PLLC

(57) ABSTRACT

A method and apparatus for manufacturing a product of integrated cellulose and fibrous materials. The method includes blending cellulose particles and polymeric fibers into a cellulose and polymeric fiber blend. The blend is heated to a temperature at which the polymeric fibers begin to melt and to bond with the cellulose particles, so as to form a product of integrated cellulose and fibrous materials. An apparatus for the method includes a first conveying means, a second conveying means, a blending means and a heating means. The apparatus further include a primary shredder and a secondary shredder for shredding the cellulose material, typically recycled newsprint, prior to mixing with the polymeric fibrous material. A shredder is also described.

14 Claims, 6 Drawing Sheets

METHOD AND APPARATUS FOR MANUFACTURING A PRODUCT OF INTEGRATED CELLULOSE AND FIBROUS MATERIALS

CROSS RELATED APPLICATION

This application is the US national phase of international application PCT/AU2008/000078 filed 24 Jan. 2008 which designated the U.S. and claims priority to Australian Patent Application No. 2007900378 filed 25 Jan. 2007, the entire contents of each of which are hereby incorporated by reference.

FIELD OF THE INVENTION

The present invention relates to a method and apparatus for manufacturing a product of integrated cellulose and fibrous materials. The invention relates particularly, though not exclusively, to such a method and apparatus for manufacturing an absorbent mat suitable for cleaning up oil spills or other liquid pollutants.

BACKGROUND TO THE INVENTION

Commonly owned Australian Patent Application No 2003271417 discloses a method and apparatus for forming products from a bouffant admixture of fibrous and cellulose materials. In AU2003271417 the fibrous material comprised wool fibre, and the invention was directed at a process for successfully combining wool fibre with cellulose to form a composite with superior insulating qualities. Typically the fibrous material employed in AU2003271417 comprised a combination of different fibrous materials including wool fibre, fibrous bonding material, fibrous filler material, polyester fibre and low melting point polyester fibre. AU2003271417 describes a preferred mixture of fibrous materials in the following proportions: approximately 50% low melting point polyester fibre; approximately 25% filler polyester fibre; and approximately 25% wool fibre. The method and apparatus of AU2003271417 was primarily designed to produce insulating batts made of the composite material, or alternatively an absorbent mat that has particular utility for soaking up oil or chemical spills.

Whilst the products formed by the method and apparatus of AU2003271417 were generally well suited to the purpose for which they were designed, the manufacturing process was somewhat expensive to operate. Furthermore, in view of the relatively high proportion of synthetic fibrous material employed in the products they were not very environmentally friendly.

The present invention was developed with a view to providing an improved method and apparatus for manufacturing a product of integrated cellulose and fibrous materials.

References to prior art in this specification are provided for illustrative purposes only and are not to be taken as an admission that such prior art is part of the common general knowledge in Australia or elsewhere.

SUMMARY OF THE INVENTION

According to one aspect of the present invention there is provided a method of manufacturing a product of integrated cellulose and fibrous materials, the method comprising the steps of:

providing a cellulose material in a particulate form as cellulose particles;

providing a polymeric fibrous material;

blending the cellulose particles and the polymeric fibres into a cellulose and polymeric fibre blend; and, heating the cellulose and polymeric fibre blend to a temperature at which the polymeric fibres begin to melt and to bond with the cellulose particles so as to form a product of integrated cellulose and fibrous materials.

Typically the cellulose particles are derived from recycled newsprint. Preferably therefore the method further comprises the step of shredding the newsprint into smaller particles. Preferably the step of shredding comprises a first shredding step and a second shredding step. The newsprint is preferably shredded to an average particle size of about 10 to 30 mm diameter in a primary shredder in the first shredding step. More preferably the newsprint is preferably shredded to an average particle size of about 20 mm diameter in a primary shredder in the first shredding step. Further the newsprint is preferably shredded to an average particle size of about 2 to 6 mm diameter in a secondary shredder in the second shredding step. More preferably the newsprint is preferably shredded to an average particle size of about 4 mm diameter in a secondary shredder in the second shredding step.

Preferably the proportion of cellulose material in the cellulose and polymeric fibre blend is between approximately 50% and 95% by weight of the total blend. More typically the proportion of cellulose material in the cellulose and polymeric fibre blend is between approximately 70% and 90% by weight of the total blend. Most preferably the proportion of cellulose material in the cellulose and polymeric fibre blend is approximately 80% by weight of the total blend. Preferably the balance of the blend in each case is made up of polymeric fibres. A typical cellulose and polymeric fibre blend according to the invention comprises 80% cellulose derived from recycled newsprint and 20% low melt polyester fibres.

According to another aspect of the present invention there is provided an apparatus for manufacturing a product of integrated cellulose and fibrous materials, the apparatus comprising:

a first conveying means for conveying a cellulose material in a particulate form;

a second conveying means for conveying a polymeric fibrous material;

a blending means, operatively connected to said first and second conveying means, for blending the cellulose particles and the polymeric fibres into a cellulose and polymeric fibre blend; and, a heating means for heating the cellulose and polymeric fibre blend to a temperature at which the polymeric fibres begin to melt and to bond with the cellulose particles so as to form a product of integrated cellulose and fibrous materials.

Typically the cellulose particles are derived from recycled newsprint. Preferably therefore the apparatus further comprises a shredder for cutting the newsprint into smaller particles. Preferably the shredder is one of a pair of shredders, a primary shredder for shredding the newsprint into an average particle size of about 10 to 30 mm diameter, and a secondary shredder for shredding the newsprint into an average particle size of about 2 to 6 mm diameter. More preferably the primary shredder shreds the newsprint into an average particle size of about 20 mm diameter, and the secondary shredder shreds the newsprint into an average particle size of about 4 mm diameter.

In a preferred embodiment the secondary shredder comprises a drum with two shafts rotatably mounted therein which are driven by a single electric motor. Each shaft of the secondary shredder preferably has a plurality of sharpened cutting blades mounted thereon in spaced apart relation to each other. In one embodiment the cutting blades are lawnmower blades which make a cleaner cut and hence reduce the amount of dust produced. The twin shafts rotate the blades at high speed and chop up the cellulose material to further reduce the size of the pieces of newsprint.

According to a further aspect of the present invention there is provided a shredder used for shredding cellulose material in an apparatus for manufacturing a product of integrated cellulose and fibrous materials, the shredder comprising:

a drum with a plurality of shafts rotatably mounted therein;

each shaft having a plurality of sharpened cutting blades mounted thereon in spaced apart relation to each other, wherein when the shafts are driven at high speed they rotate the blades to chop up cellulose material into smaller particles.

According to a still further aspect of the present invention there is provided a product of integrated cellulose and fibrous materials made in accordance with the method of the invention.

Throughout the specification, unless the context requires otherwise, the word "comprise" or variations such as "comprises" or "comprising", will be understood to imply the inclusion of a stated integer or group of integers but not the exclusion of any other integer or group of integers. Likewise the word "preferably" or variations such as "preferred", will be understood to imply that a stated integer or group of integers is desirable but not essential to the working of the invention.

BRIEF DESCRIPTION OF THE DRAWINGS

The nature of the invention will be better understood from the following detailed description of a preferred embodiment of the method and apparatus for manufacturing a product of integrated cellulose and fibrous materials, given by way of example only, with reference to the accompanying drawings, in which.

DETAILED DESCRIPTION OF PREFERRED EMBODIMENTS

Figure 1:
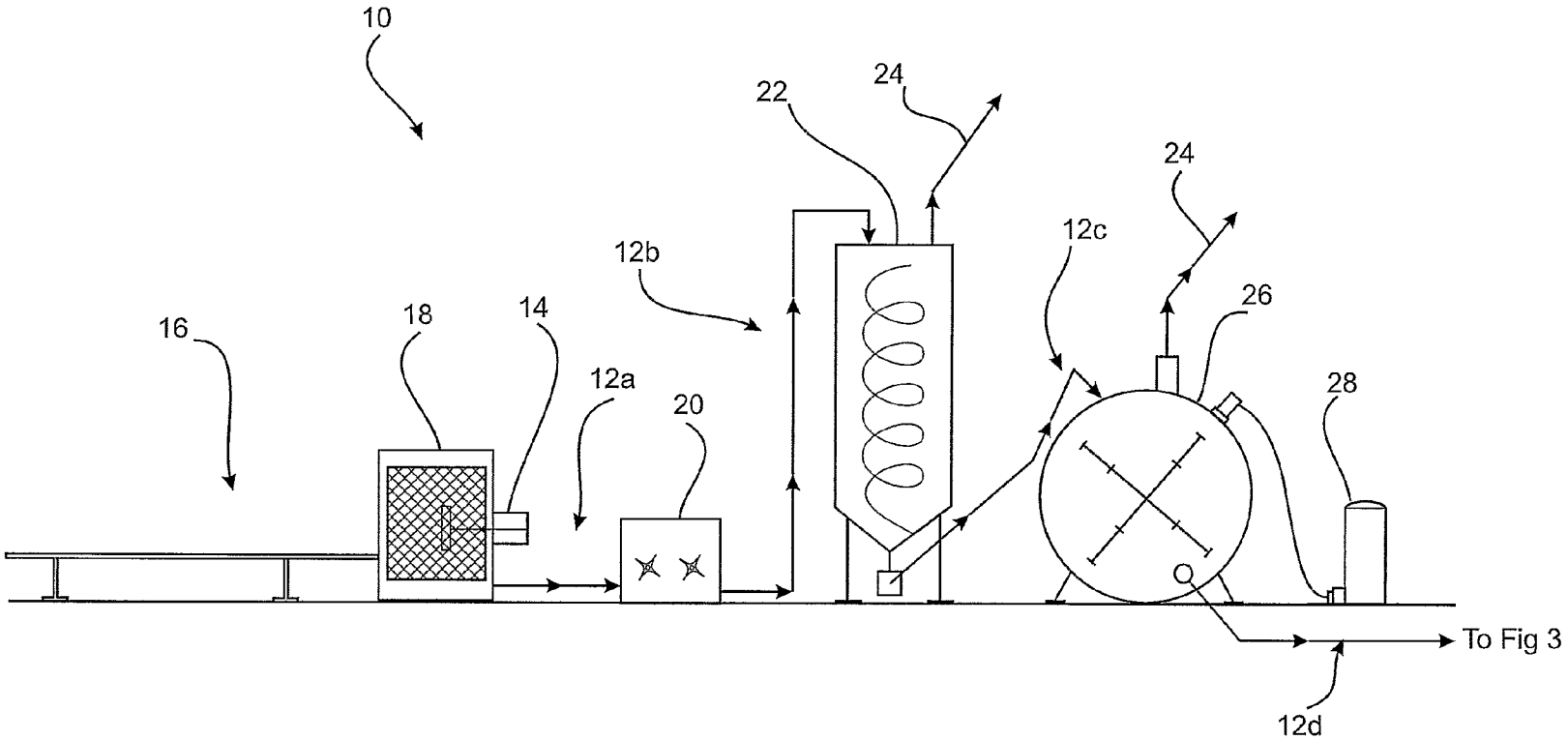
FIG. 1 illustrates a cellulose section of a preferred embodiment of the method and apparatus for manufacturing a product of integrated cellulose and fibrous materials according to the invention.

FIGS. 1 to 4 together illustrate a preferred embodiment of an apparatus 10 for manufacturing a product of integrated cellulose and fibrous materials in accordance with the invention. The product has particular application for absorbing industrial spills such as oil and grease spills.

The apparatus 10 preferably comprises a first conveying means 12 for conveying a cellulose material in a particulate form to the next stage of the apparatus. The cellulose material employed in the method and apparatus of the invention is preferably obtained from recycled paper, preferably newsprint, which must first be shredded to convert the paper into a cellulose material in particulate form. Hence the apparatus 10 of this embodiment preferably further comprises a primary shredder 14 for shredding the newsprint into pieces with an average particle size of about 10 to 30 mm, and more preferably a particle size of about 20 mm. The recycled newsprint is fed via a timed conveyor belt 16 to a trommel 18, in which the newsprint is tumbled to separate the sheets of paper prior to shredding by the primary shredder 14 which is connected thereto.

The first conveying means of this embodiment comprises a first air stream 12*a* which carries the shredded paper particles from the primary shredder 14 to a secondary shredder 20 and a second air stream 12*b* which carries the shredded paper particles from the secondary shredder 20 to the next stage in the process. However, in some situations, cellulose of the desired particle size may be supplied to the apparatus 10 and there is no need to include the shredders 14 and 20 in the process.

The secondary shredder 20 comprises a drum 70 with two shafts 72 rotatably mounted therein which are driven by a single 30 HP electric motor 74. Each shaft 72 of the secondary shredder 20 has a plurality of sharpened cutting blades 76 mounted thereon in spaced apart relation to each other. Lawnmower blades have been found to work particularly well for this purpose, as they make a cleaner cut and hence reduce the amount of dust produced; however other types of blades may also be employed. It should be noted that the reduction of dust in the invention is of particular importance due to the fact that in order to obtain a final suitable product, the materials can only bond together well enough in the heating step in the absence of excess dust.

The drum 70 includes a lower perforated surface 78. The cross sectional shape of the lower surface 78 perpendicular to the shafts 72 is generally arcuate in shape. A stream of air is directed generally horizontally and perpendicular to the shafts 72 from a first end 80 of the drum 70 towards a second opposed end 82 of the drum 70. The air stream passes through the perforations to move the paper so it may be more effectively shredded by the blades 76.

Figure 5:
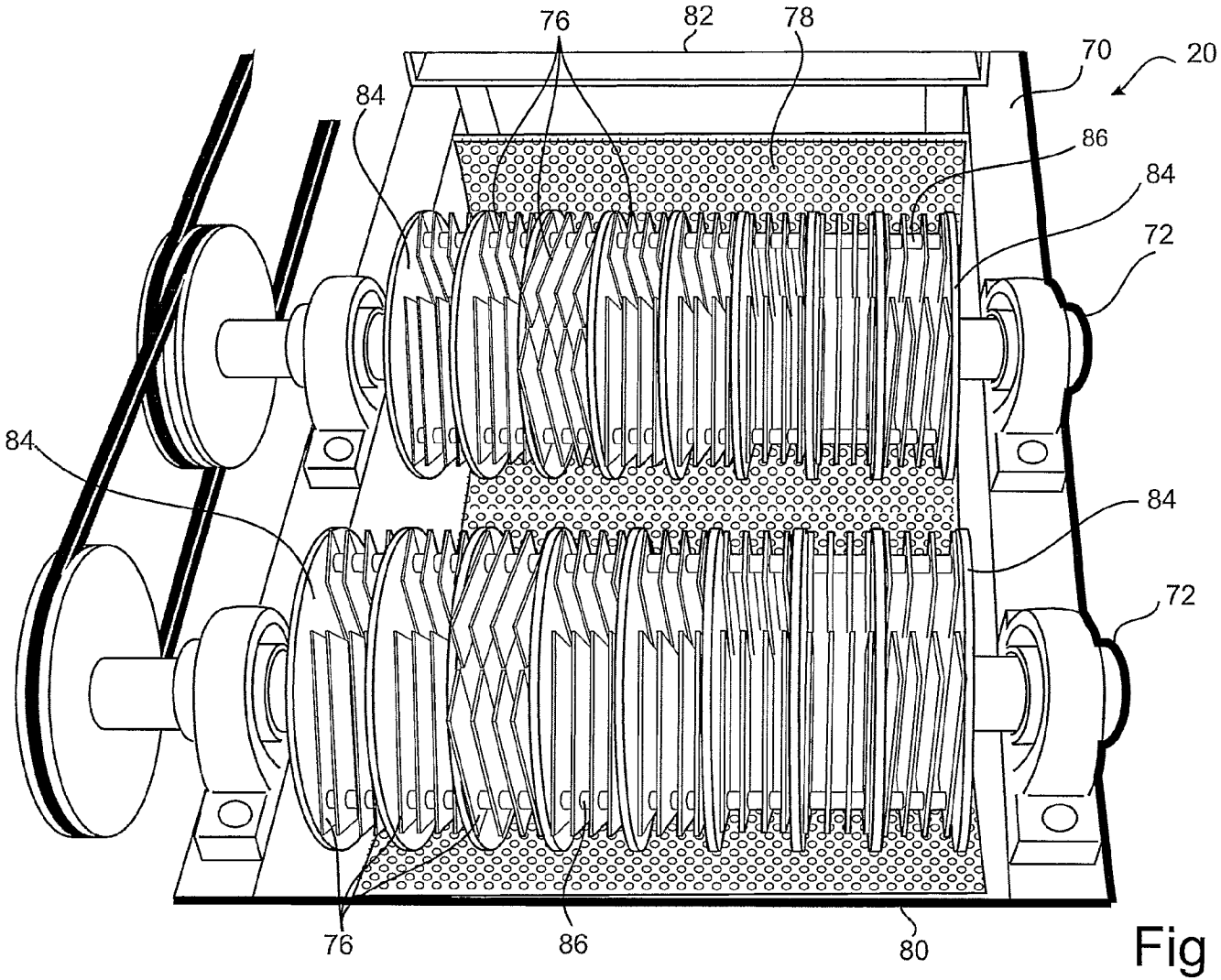
FIG. 5 is an upper perspective view of the secondary shredder of the present invention.

Each shaft 72 includes a plurality of disks 84 mounted perpendicular to the shaft along the length thereof. The disks 84 support a plurality of support rods 86 around the periphery thereof, mounted parallel to the shaft 72. The blades 76 are mounted onto the support rods 86 such that the blades 76 can rotate about the support rods 86. In the embodiment shown, each shaft includes three support rods 86, each having 32 blades mounted along the length thereof. The secondary shredder 20 therefore includes one hundred and ninety two blades in total. The blades are typically two inch or three inch in width. The blades 76 are pivotally mounted in sets of four along the length of each respective support rod 86. Each blade 76 overlaps in an opposing direction with a blade 76 from another set of four blades on an adjacent support rod 86 in the rest position, as shown in FIG. 5.

Figure 6:
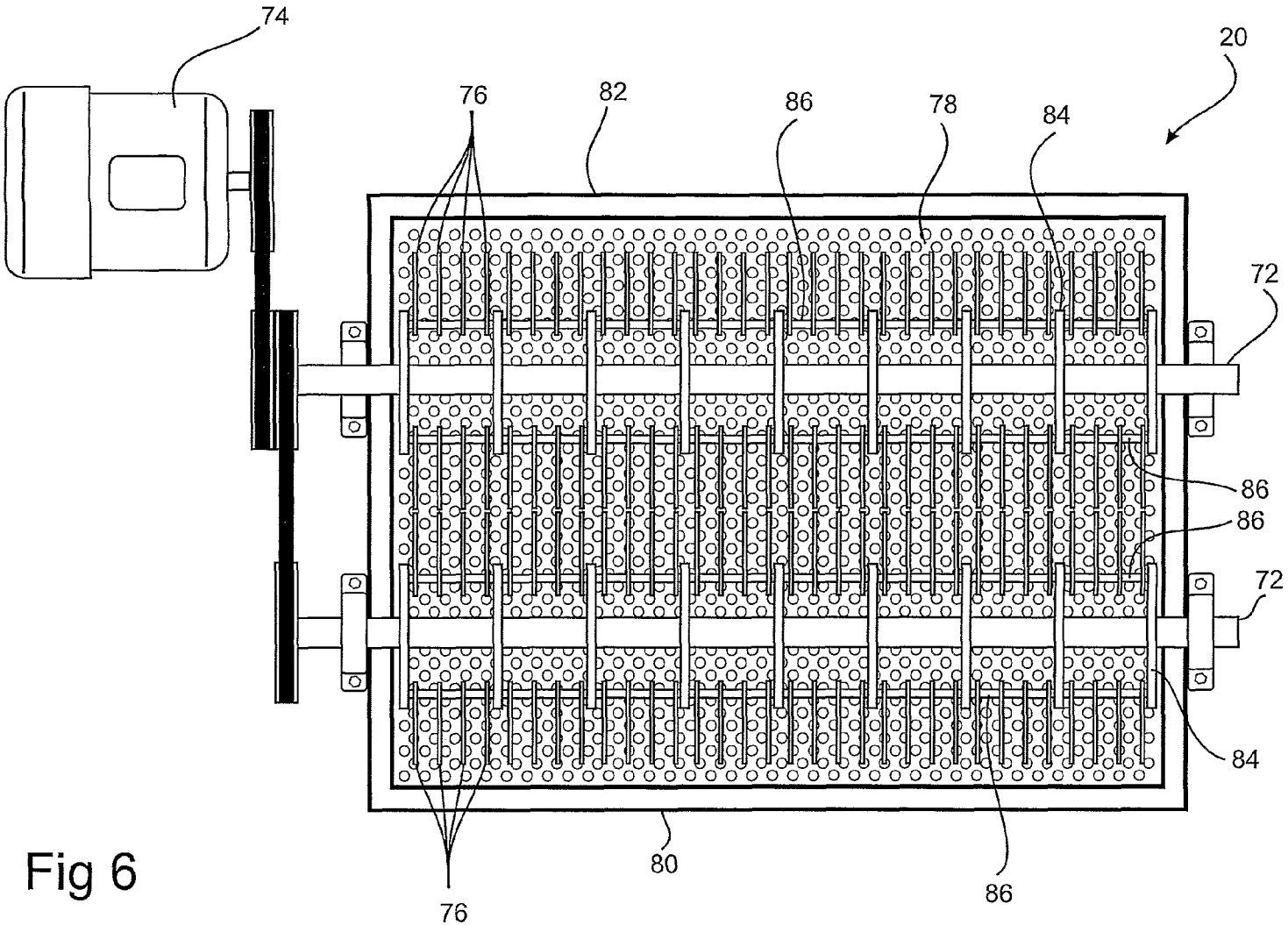
FIG. 6 is a top view of the shredder of FIG. 5 in operation.

As the two shafts 72 rotate, the blades pivot outwardly due to the centrifugal force to a position in which they extend radially outwards with respect to the shaft 72. The two shafts 72 are spaced apart a sufficient distance so that when the blades on the respective shafts are fully extended outwardly during rotation, they almost, but do not quite, touch as shown in FIG. 6. The twin shafts 72 rotate the blades at high speed (typically at about 2000 rpm) and chop up the cellulose material to further reduce the size of the pieces of newsprint to an average particle size of about 2 to 6 mm diameter, and more specifically to a particle size of about 4 mm diameter. This reduced particle size allows for better blending with the polymeric fibres, and better mixing of the components in the heating stage.

The secondary shredder 20 allows for the production of shredded newsprint of a suitable particle size for use in the invention and without the production of an excessive amount of dust. The blades allow for a sharp, clean cut which reduces the production of dust. In prior art methods, hammermills are commonly used to break up paper but these techniques are known to produce large amounts of dust.

The shredded newsprint (particulate cellulose material) is conveyed from the secondary shredder 20 to a cyclone 22 by a third air stream 12*c*. The purpose of cyclone 22 is to separate dust from the particulate cellulose material. The dust is extracted from the cyclone 22 via dust extraction vent 24. The dust produced during the shredding of the newsprint is found not to bond as well to the fibrous material in the integrated product, and therefore is best removed at an early stage. A dust extraction vent (not shown) may also be provided on the secondary shredder 20. The extracted dust is preferably carried by an air stream to a dust hopper (not shown) located outside the facility housing the apparatus 10.

Preferably the particulate cellulose material is chemically treated with fire retardant and vermin repellent chemical solutions. Preferably the particulate cellulose material is also treated with a hydrophobic chemical solution. For this purpose the apparatus 10 preferably further comprises a first mixing tank 26 for mixing suitable chemical solutions with the particulate cellulose material. The chemical solutions are injected into the first mixing tank 26 via a chemical injection system 28. A further dust extraction vent 24 is provided for extracting dust from the first mixing tank 26. The treated cellulose particles of this embodiment are now ready for blending with the polymeric fibrous material. A fourth air stream 12*d* conveys the treated cellulose particles from the mixing tank 26 to the next stage of the process.

The apparatus 10 preferably further comprises a second conveying means for conveying a polymeric fibrous material to the next stage in the process of manufacturing the integrated product. The polymeric fibrous material employed in the process of the invention is preferably a low melting point polyester fibre, such as 4 denier×51 mm Polyester staple fibre. However any suitable polymeric fibrous material may be employed in the process of the invention, provided that the polymeric fibres begin to melt when subject to elevated temperatures.

Figure 2:
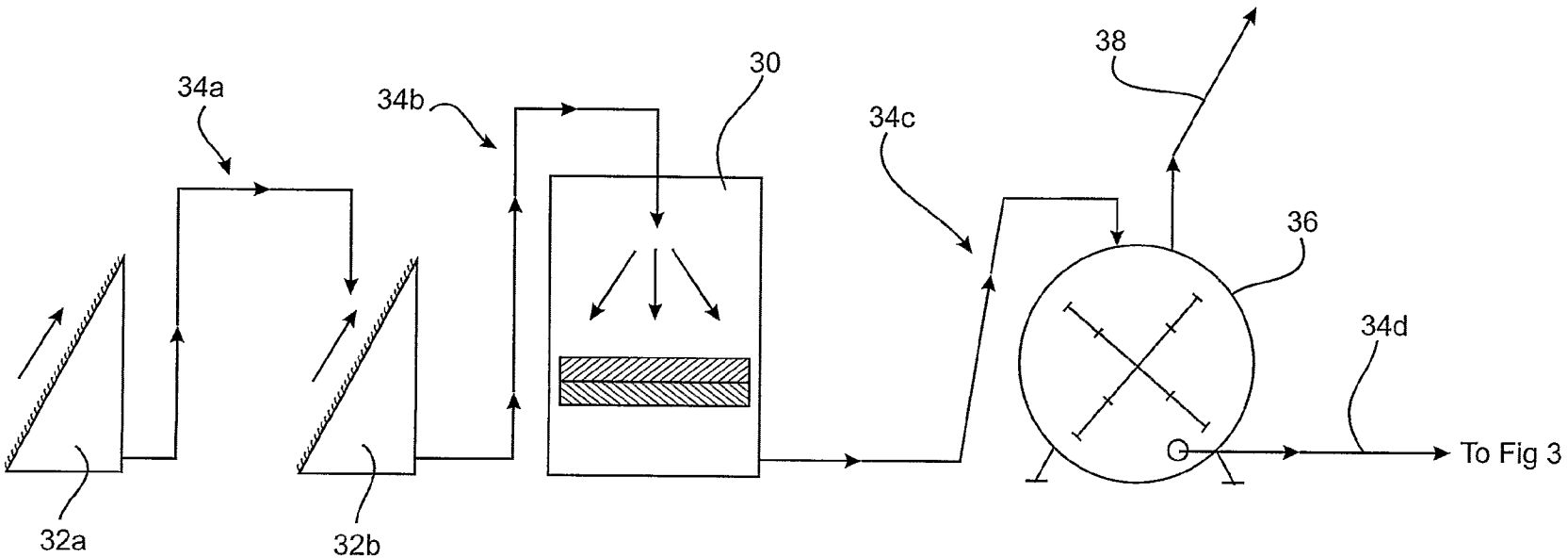
FIG. 2 illustrates a fibre section for the method and apparatus of FIG. 1.
Figure 3:
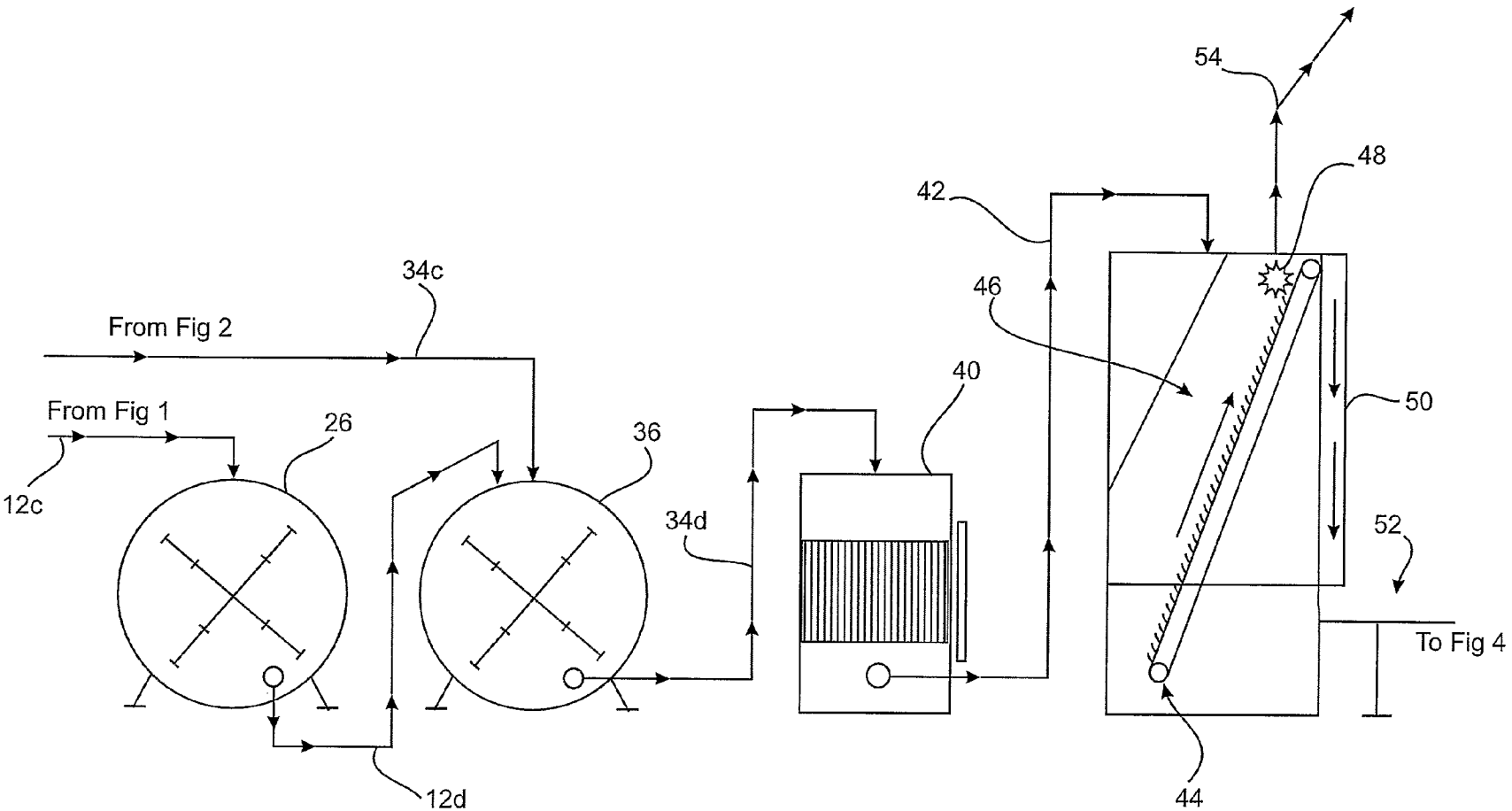
FIG. 3 illustrates a mixing section for the method and apparatus of FIG. 1.
Figure 4:
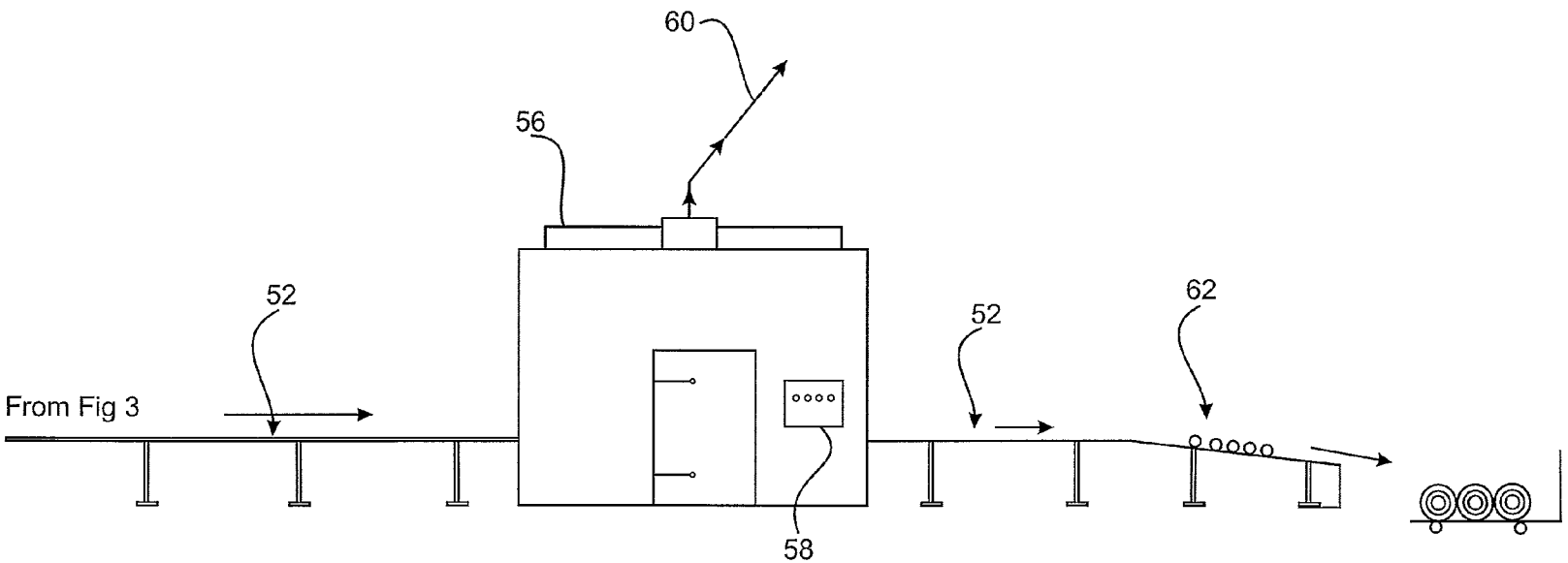
FIG. 4 illustrates a bonding and cutting section for the method and apparatus of FIG. 1.

The apparatus 10 preferably further comprises a separator/fine opener 30 for separating the fibres of the polymeric fibrous material and splitting them into smaller particles (see FIG. 2). In this embodiment, the second conveying means comprises a pair of spiked conveyors 32*a* and 32*b*, a first air stream 34*a* for conveying the fibres between the conveyors 32 and a second air stream 34*b* for conveying the fibres from the second spiked conveyor 32*b* to the separator/fine opener 30. A fourth air stream 34*c* conveys the separated and split fibres to a second mixing tank 36. A dust extraction vent 38 extracts dust and excess air from the second mixing tank 36 to the dust hopper (not shown) located outside. A fourth air stream 34*d* conveys the contents of the second mixing tank 36 to the next stage of the process.

The apparatus 10 preferably further comprises a blending means 40 (see FIG. 3) operatively connected to the first and second conveying means, for blending the cellulose particles and the polymeric fibres into a cellulose and polymeric fibre blend. Both the first mixing tank 26 and the second mixing tank 36 are reproduced in FIG. 3, although these have already been illustrated in FIGS. 1 and 2 respectively. A metered quantity of the treated cellulose particles from the first mixing tank 26 is conveyed via air stream 12*d* to the second mixing tank 36 for mixing with the separated and split fibres in the second mixing tank. After mixing in the second mixing tank 36 for a prescribed time of about 5 minutes (or long enough to mix the components), the mixed product is then fed via air stream 34*d* to the blending means 40. The blending means 40 thoroughly blends the cellulose particles and the polymeric fibres into a cellulose and polymeric fibre blend. In one embodiment the blending means is a 1947 wool blender, which separates the polyester fibres so as to achieve a uniform blending of the cellulose particles throughout the blend.

Importantly, the proportion of cellulose material in the cellulose and polymeric fibre blend is between approximately 50% and 95% by weight of the total blend. More typically the proportion of cellulose material in the cellulose and polymeric fibre blend is between approximately 70% and 90% by weight of the total blend. Most preferably the proportion of cellulose material in the cellulose and polymeric fibre blend is approximately 80% by weight of the total blend. The balance of the blend in each case is made up of polymeric fibres. Hence a typical cellulose and polymeric fibre blend according to the invention comprises 80% cellulose derived from recycled newsprint (newspaper) and 20% low melt polyester fibres.

The high proportion of cellulose in the integrated product provides a number of advantages. Firstly, it means that the bulk of the product is bio-degradable and hence the product is much more environmentally friendly than comparable products made predominantly from synthetic materials. Secondly, the high proportion of cellulose means that the integrated product has far superior absorption properties. Tests indicate that the dry product of integrated cellulose and fibrous materials can absorb over 15 times its own weight in oil. For example, a dry pad of the product weighing 26 grams placed on the surface of a liter of oil for five minutes weighed 458 grams, indicating it had absorbed 16.6 times its own weight of oil. The pad could be lifted from the container of oil and carried without any oil dripping from it.

The blended product from the blending means 40 is then conveyed via an air stream 42 to an air layer hopper 44. A spiked conveyor 46 within the hopper 44 then feeds the blended product through two high-speed beaters 48 to even the flow of product into a volumetric feeder system 50. The purpose of the volumetric feeder system 50 is to control the density of the blended product. This is accomplished by gravity feed of the blended product into a vertical column of air within the volumetric feeder system 50. The blended product exits the volumetric feeder system 50 onto a conveyor belt 52 which carries the product to the next stage of the process. A dust extraction vent 54 removes dust from the air layer hopper 44 and the volumetric feeder system 50 to the dust hopper (not shown) outside.

The apparatus 10 preferably further comprises a heating means in the form of an oven 56 for heating the cellulose and polymeric fibre blend to a temperature at which the polymeric fibres begin to melt and to bond with the cellulose particles so as to form a product of integrated cellulose and fibrous materials. A layer of the blended product is conveyed under a flattening roller (not shown) and into the oven 56 on the conveyor belt 52 made of heat-resistant Kevlar material. The temperature of the oven 56 is typically kept constant in the range of approximately 125° C. to 135° C., depending on the speed at which the product is moved through the oven. The speed at which the product passes through the oven 56 also depends on the thickness of the product layer, which is typically between 18 mm to 40 mm thick, although even thicker layers can be produced. The temperature of the oven 56 is precisely controlled via a control panel 58. Oven exhaust gases are vented via an oven exhaust vent 60.

As the rolled product passes through the oven 56 the polyester fibres begin to melt and bond with the blended cellulose particles to form a blanket of integrated cellulose and fibrous materials. The blanket exits the oven 56 on the conveyor belt 52 and passes through a plurality of cutters 62 which cut the blanket into appropriate width strips of the finished integrated product. The strips of the finished product are rolled into rolls or cut into pads ready for packaging and transport. The finished product can be formed into booms, mats, pads, rolls, mops, blankets and pillows depending on the desired application. As noted above, its superior absorption properties render the product particularly suitable for cleaning-up oil and chemical spills. However it can also be used for thermal and acoustic insulation such as batts in ceilings and walls of buildings and other structures. The integrated cellulose and polyester fibre product was found to be sufficiently strong and well-opened to be fastened with tech-screws, making it particularly attractive to the building industry.

The embodiments shown in the Figures also illustrates the method of the invention for manufacturing a product of integrated cellulose and fibrous materials. The method comprises the steps of providing a cellulose material in a particulate form as cellulose particles such as newsprint, which is blended in a blending means 40 with a polymeric fibrous material into a cellulose and polymeric fibre blend. The cellulose and polymeric fibre blend is heated (in an oven 56) to a temperature at which the polymeric fibres begin to melt so as to bond with the cellulose particles to form the product of integrated cellulose and fibrous materials.

Now that preferred embodiments of the method and apparatus for manufacturing a product of integrated cellulose and fibrous materials have been described in detail, it will be apparent that the embodiments provide a number of advantages over the prior art, including the following:

(i) It produces a product of integrated cellulose and fibrous materials with absorption properties, making it particularly suitable for cleaning-up oil spills and chemical spills.

(ii) It involves a simplified process that is less expensive to operate than the prior art method and apparatus.

(iii) It produces a product of integrated cellulose and fibrous materials that is more environmentally friendly than comparable prior art products which are made predominantly of synthetic materials.

(iv) It can be readily fully automated to produce a product of integrated cellulose and fibrous materials on a continuous basis with little or no human intervention.

(v) It produces a product of integrated cellulose and fibrous materials that can be easily cut into a desired size and shape.

(vi) Since the method uses recycled newspaper, it is an environmentally friendly process.

It will be readily apparent to persons skilled in the relevant arts that various modifications and improvements may be made to the foregoing embodiments, in addition to those already described, without departing from the basic inventive concepts of the present invention. Therefore, it will be appreciated that the scope of the invention is not limited to the specific embodiments described.

The claims defining the invention are as follows:

1. A method of manufacturing a product of integrated cellulose and fibrous materials, the method comprising:

shredding recycled newsprint into smaller particles to form cellulose particles with an average particle size of no greater than 30 mm in diameter;

separating dust from the cellulose particles;

treating the cellulose particles by using a hydrophobic chemical;

providing a polymeric fibrous material including polymeric fibers, wherein the average length of the polymeric fibers is at least 51 mm;

blending the cellulose particles and the polymeric fibers into a cellulose and polymeric fiber blend; and, heating the cellulose and polymeric fiber blend to a temperature at which the polymeric fibers begin to melt and to bond with the cellulose particles so as to form a product of integrated cellulose and fibrous materials, wherein the product of integrated cellulose and fibrous materials is capable of absorbing oil at least 15 times the weight of the product of integrated cellulose and fibrous materials.

2. The method of manufacturing a product of integrated cellulose and fibrous materials as claimed in claim 1, wherein the step of shredding comprises a first shredding step and a second shredding step.

3. The method of manufacturing a product of integrated cellulose and fibrous materials as defined in claim 2, wherein the newsprint is shredded to an average particle size of about 10 to 30 mm diameter in a primary shredder in the first shredding step.

4. The method of manufacturing a product of integrated cellulose and fibrous materials as defined in claim 3, wherein the newsprint is shredded to an average particle size of about 2 to 6 mm diameter in a secondary shredder in the second shredding step.

5. The method of manufacturing a product of integrated cellulose and fibrous materials as defined in claim 2, wherein the average particle size is no greater than 20 mm in diameter.

6. The method of manufacturing a product of integrated cellulose and fibrous materials as defined in claim 1, wherein the proportion of cellulose material in the cellulose and polymeric fiber blend is between approximately 50% and 90% by weight of the total blend.

7. The method of manufacturing a product of integrated cellulose and fibrous materials as defined in claim 6, wherein the balance of the blend in each case is made up of polymeric fibers.

8. The method of manufacturing a product of integrated cellulose and fibrous materials as claimed in claim 1, wherein the product of integrated cellulose and fibrous materials is one of an absorbent, an acoustic insulator and a thermal insulator.

9. The method of manufacturing a product of integrated cellulose and fibrous materials as claimed in claim 1, wherein the fibrous material is a low melt polyester.

10. A method to make an integrated product blend of recycled newspaper and polymeric fibers comprising:

shredding recycled newspaper to form cellulose particles having an average diameter of no greater than 30 mm;

separating dust from the formed cellulose particles;

treating the formed cellulose particles by using a hydrophobic chemical;

blending the cellulose particles with polymeric fibers to form a blend of the cellulose particles and the polymeric fibers, wherein an average length of the polymeric fibers is at least 51 mm; and heating the blend to cause the polymeric fibers to bond with the cellulose particles to form the integrated product blend, wherein the integrated product blend is capable of absorbing oil at least 15 times the weight of the integrated product blend.

11. The method of claim 10 wherein the polymeric fiber constitute 50% to 95% by the weight of the integrated product blend.

12. The method of claim 10 wherein the shredding comprises a first shredding of the recycled newspaper which reduces the newspaper to cellulose particles having average diameters in a range of 10 mm to 30 mm, and a second shredding in which cellulose particles are produced having average diameters in a range of 2 mm to 6 mm.

13. The method to make an integrated product blend of claim 10, wherein the integrated product blend is one of an absorbent, an acoustic insulator and a thermal insulator.

14. The method to make an integrated product blend of claim 10, wherein the fibrous materials is a low melt polyester.

* * * * *